US005732921A

United States Patent [19]

Lemire

[11] Patent Number: 5,732,921

[45] Date of Patent: Mar. 31, 1998

[54] CLIP WITH SERRATED LOCKING MEANS

[75] Inventor: Paul Lemire, Jacksboro, Tenn.

[73] Assignee: Allen Field Company, Inc., Farmingdale, N.Y.

[21] Appl. No.: 664,737

[22] Filed: Jun. 17, 1996

[51] Int. Cl.[6] ..... A41F 1/00

[52] U.S. Cl. ..... 248/317; 248/316.5; 248/551; 24/515; 24/517

[58] Field of Search ..... 248/317, 316.5, 248/316.7, 551, 320, 214; 24/515, 517, 336, 337, 348, 489

[56] References Cited

U.S. PATENT DOCUMENTS

| | | | |
|---|---|---|---|
| 125,311 | 4/1872 | Lucas . | |
| 836,838 | 11/1906 | Shay | 24/489 X |
| 902,795 | 11/1908 | Appleton . | |
| 1,683,049 | 9/1928 | Penley . | |
| 1,797,452 | 3/1931 | Teel . | |
| 2,058,102 | 10/1936 | Philipp | 248/316.5 X |
| 4,489,466 | 12/1984 | Bakker | 24/489 |
| 5,165,147 | 11/1992 | Kuo | 24/346 |
| 5,457,857 | 10/1995 | Lam | 24/503 |

*Primary Examiner*—Robert W. Gibson, Jr.
*Assistant Examiner*—Stephen S. Wentsler
*Attorney, Agent, or Firm*—Nolte, Nolte and Hunter, P.C.

[57] ABSTRACT

A serrated thrust element inserted between serrated portions of handles of a clip, forces the jaws of the clip closed by a single unidirectional movement toward the pivot of the clip between the handles and the jaws. The clip may be hung by the thrust element without affecting the jaw spacing.

16 Claims, 7 Drawing Sheets

CLIP WITH SERRATED LOCKING MEANS

BACKGROUND OF THE INVENTION

1. Field of the Invention

This invention pertains to clips, more specifically to a one-piece molded plastic clip that can be hung from a support, holds an item to face in any of a plurality of directions when the clip is hung from the support, has adjustable grip force, has locking grip, can be unlocked by one finger, maintains a constant gripping force during the unlocking process, and includes a saw tooth wedge and support hock joined by a flexible guide and security link to the body of the clip.

2. Description of the Prior Art

Many clip users need a clip which securely holds an item, yet releases the item easily, and can be used to hang the item from a support and display the item in one of several available directions with respect to the support.

For example, in retail applications of a clip, the item held by the clip may be light but subject to strain from handling by customers, such as gloves, or may be heavy such as a pair of boots. Any clerk having limited finger strength and dexterity should be able to apply the clip so that it clamps on an item or clamps on parts of two adjacent items with high force so that they can be hung by the clip.

The clerk should also be able to remove the clip without applying force or having high manual dexterity.

This is not easy to do with most clips which have a spring biased against a pair of opposed finger grip levers, operating across a fulcrum to close jaws for gripping the item. The grip force of the clip depends upon the strength of the spring, yet the user must force the levers against the spring in order to open the jaws to place the clip on the item or to release the grip of the clip on the item. U.S. Pat. No. 5,165,147, patented Nov. 24, 1992, by H. Kuo describes a clip having a top elongate element and a bottom elongate element. The top and bottom elongate elements are joined by a pair of side mounted pivots so that the front ends of the elongate elements form the jaws of the clip, and the back ends of the elongate elements are the handles of the clip.

A pair of arcuate spring metal strips, the front ends of which are attached to the top and bottom elements at the jaws, pass between the pivots, and join together in a C-shape between the handles of the clips. The arcuate spring metal strip assembly presses outward against the inward facing sides of the top and bottom elements, holding them apart whereby the jaws are forced shut. One of the strips is bent into a hook at the rear end of the strip, for hanging the clip from a support.

In another application example, a clip used in clothing suspenders must grip tightly on fabric of various thicknesses, yet be opened easily. A suspender clip is usually operated by a lever which moves the jaws between an open position and a predetermined closed position than may not be suited to the thickness of the fabric at the waist of the pants. This often results in the clip slipping from the pants.

U.S. Pat. No. 4,489,466, patented by J. A. Bakker, on Dec. 25, 1984 describes a suspender fastener which has jaws operated by a pair of pivotally connected levers via fulcrum at the pivot.

The inward facing surfaces of the levers each have a pair of parallel rows of serrations which increase in height as the distance between serration and pivot increases.

A shaft located between the levers, being transverse to the length of the levers, has an irregular shape in cross section so that it forms a catch that can be rotated by a radial, flat, bar attached to the ends of the shaft beyond the sides of the levers, by moving the bar around the axis of the shaft. The bar has a transverse loop at the distal end of the bar, for holding an end of a suspender strap.

The irregular shaped catch and radial bar form a rotatable ratchet which alternatively grips opposed serrations of the facing levers so that the ratchet is forced to move away from the pivot along the increasingly higher serrations. The further that the catch moves to The higher serrations, the greater it spreads the levers which forces the jaws tighter together.

A roller on the shaft between the parallel rows of serrations keeps the shaft centered on the rows.

Tightening of the jaws of the suspender is done by repeatedly rotating the bar back and forth through an acute angle, preferably about 35 degrees relative to the longitudinal disposition of the shaft. Maximum closure of the jaws is reached when the catch reaches a high tooth of the serrations at the distal end of the lever.

Releasing of the jaw clamping force is done by rotating the bar through a greater angle, preferably of about 90 degrees relative to the longitudinal disposition of the bar, whereupon the serration gripping portion of the catch rotates out of engagement with the serrations. Clamping force can then be gradually reduced as the catch is moved closer to the pivot where the serrations are of low height.

It is apparent that rotating the bar applies lateral force upon the clip. This applies twisting force between the jaws and the item being held by the jaws which tends to force the jaws apart when the item is stiff.

SUMMARY OF THE INVENTION

It is the object of the invention to provide a clip which can be tightened on an object by applying pressure lengthwise to the clip to locking insert element of the clip.

It is another object that it not be necessary to squeeze the clip to release the jaws from an item.

It is another object that the clip can be adjusted from full open jaws to maximum jaw closure by making a single, unidirectional movement lengthwise of an element of the clip.

It is another object that the jaws can be locked on an item.

It is another object that the jaw force is constant during movement of clip elements for unlocking the jaws.

It is another object that an item can be hung from a support by way of the clip.

It is another object that the item can be hung by the clip facing in one of a plurality of directions relative to the support.

It is another object than the clip can be hung from the locking insert element.

It is another object that any one of a plurality of jaw spacings of the clip remains constant and unaffected by the clip being hung by the insert element.

It is another object that the locking insert element be molded as one piece with the clip.

It is another object that the clip can be unlocked by sliding the locking insert out from the clip body.

It is another object that the clip can be unlocked by sliding the locking insert laterally no the front to back axis of the clip.

It is another object that the clip can be reused and has a first-use tamper evident feature.

Other objects and advantages will become apparent to one reading the ensuing description.

A clip having a front and a back, has a first body member comprising a first jaw toward the front and a first lever toward the back, and a second body member comprising a second jaw and a second lever.

Joining means connects the first body member to the second body member between the jaws and the levers so that the first and second jaws are moved toward one another by the first and second levers when the first and second levers are moved away from one another.

A first side of the first lever faces the second lever. A third body member is dimensioned to fit between the first and second levers in close contact with the first and second levers between the joining means and the back of the clip when the jaws of the clip are in a closed position.

A first serration is en the third body member, and a second serration is on the first side.

The third body member is slidable in the direction from the back to the joining means simultaneously with the first serration in contact with the second serration so that the clip can be adjusted from open jaws to maximum jaw closure by sliding the third body member in a single unidirectional movement from the back to the joining means.

Means comprising serration between the third body member and the first body member are on the third body member for preventing sliding along a portion of the length of the first side by the third body member in a direction from the joining means toward the back of the clip. The grooves of the serration are transverse to the length of the clip and open no a side of the clip so than the third body member is removable from between the first and second body members by sliding laterally to the length.

A flexible line is attached to the third body member and the first body member. The line can be made too short to permit removal of the third body member from all portions of the serration.

The third body member has a plurality of sides, preferably two of adjacent sides of the plurality of sides have serration.

Preferably the first body member, second body member, third body member, joining means, and flexible line are a one piece molding.

Attachment means are on the third body member for attaching the third body member to a support for supporting the clip by the third body member.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
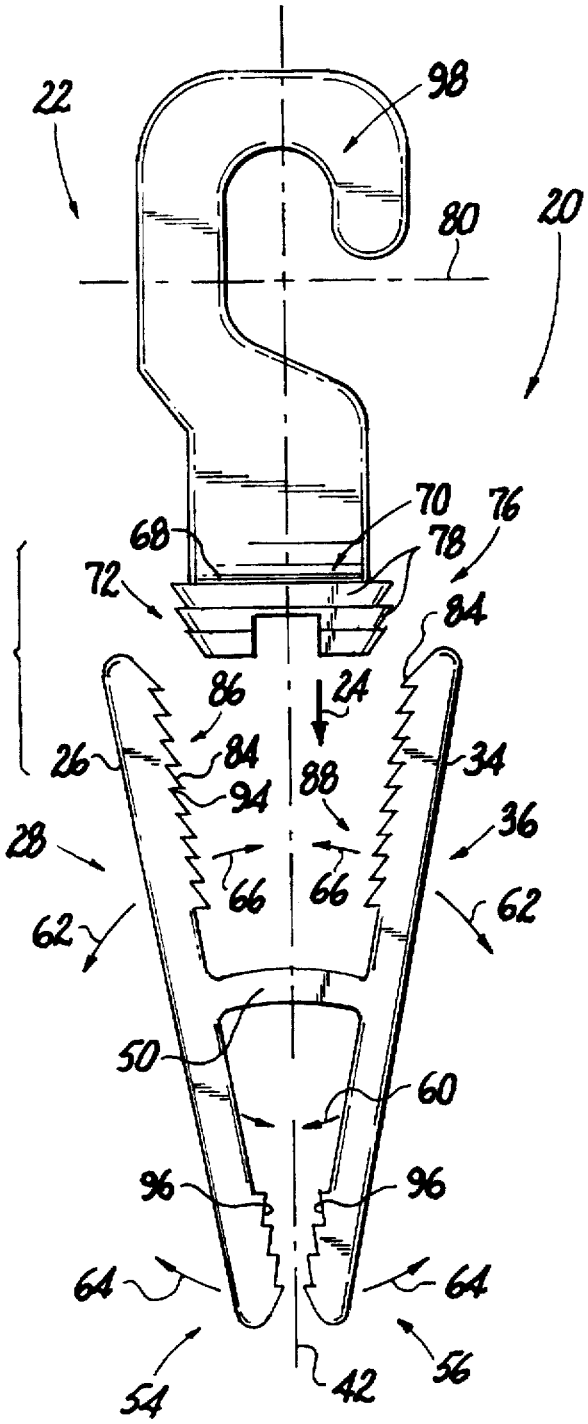
FIG. 1 is a front view of a clip and a locking insert thrust body of the invention shown with the locking insert spaced from the lever portions of the clip.

Before explaining the invention in detail, it is to be understood that the invention is not limited in its application to the detail of construction and arrangement of parts illustrated in the drawings since the invention is capable of other embodiments and of being practiced or carried out in various ways, it is also to be understood that the phraseology or terminology employed is for the purpose of description only and not of limitation.

Figure 2:
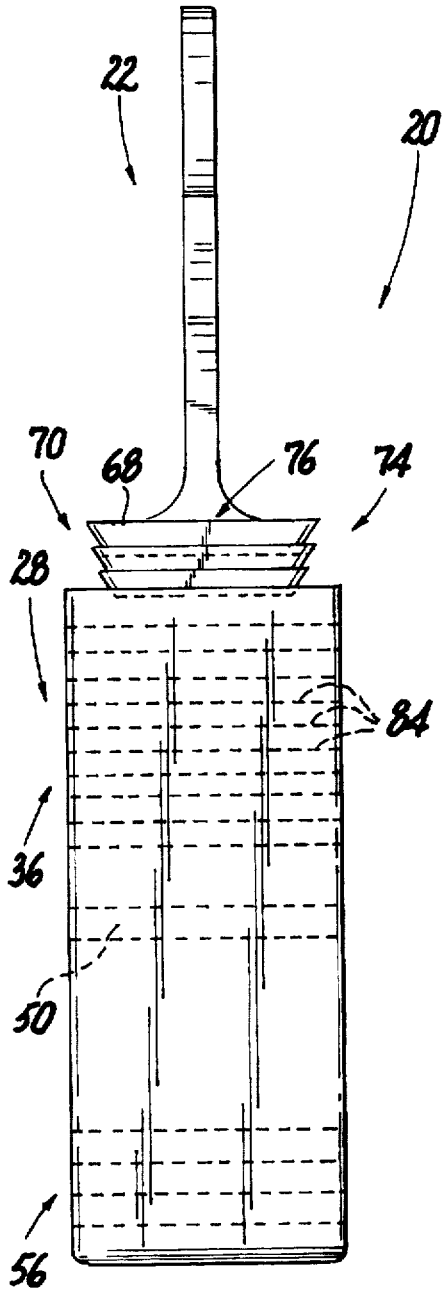
FIG. 2 is a right side view of the clip of FIG. 1.

In FIGS. 1 and 2, thrust body 22 of clip 20 is positioned for insertion 24 between lever 26 of body member 28 and lever 34 of body member 36 along longitudinal axis 42 of the clip.

Jaws 54, 56 are in a relaxed as-cast configuration. Joiner 50, and body members 28 and 36 are cast in one piece, preferably as part of an extrusion from which successive clips are cut.

Body members 28 and 36 rotate on joiner 50 so that jaw 54 and jaw are moved 60 toward one another by levers 26 and 34 when the levers are moved 62 away from one another, and the jaws are moved 64 away from one another by the levers being moved 66 toward one another.

Thrust body 22 has serration 68 on four adjacent sides, 70, 72 74, and 76. The serration portion is square in cross section, and diminishes in width on a diagonal, longitudinally. Grooves 78 of serration 68 are transverse 80 to the length of clip 20 The length of clip 20 generally follows longitudinal axis 42.

Levers 26 and 34 have serration 84 on sides 86 and 88 which face each other. Grooves 94 of serration 84 are transverse 80 to the length of clip 20.

Jaws 54 and 56 have serration 96 for gripping items held by the clip.

Hook 98 is designed to attach thrust body 22 to a suitable support such as a retail store clothing rack bar or ring (not shown), for supporting the clip by the thrust body when thrust body serration 68 is engaged in lever serration 84.

Figure 3:
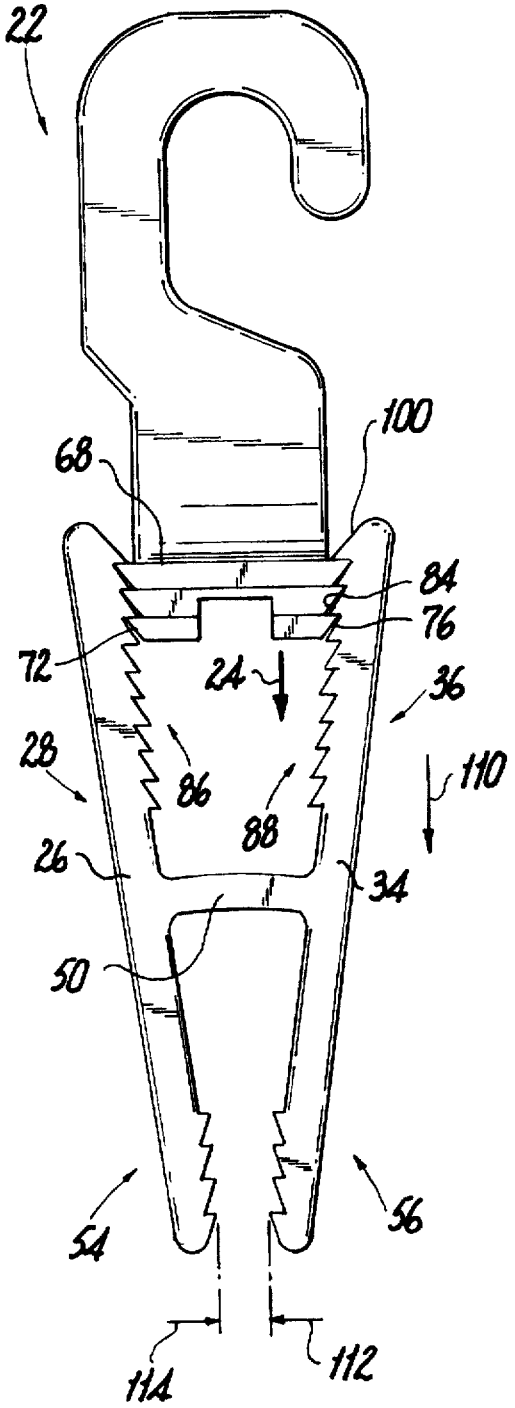
FIG. 3 is a front view of the clip of FIG. 1 shown with the lockinginsert thrust engaging the backmost serrations of the lever portion of the clip.

In FIG. 3, thrust body 22 is inserted 24 lengthwise of the clip into-back end 100 of clip 20 between levers 34 and 26. Sides 72 and 76 of thrust body 22 slide forward 110 toward joiner 50 and front end 112 over sides 86 and 88 respectively of levers 26 and 34.

Serration 68 on thrust body 22 slides forward over serration 84 on the lever sides without being stopped by the serration which is shaped to prevent rearward sliding of the thrust body along the sides of the levers in a direction from the joiner toward the back of the clip.

As the thrust body is moved forward between sides 86 and 88 it spreads levers 26 and 34 apart, causing body members 28 and 36 to rotate or pivot on flexible joiner 50 causing jaw 54 and jaw 56 to move forward one another. Jaws 54, 56 are spaced 114.

Figure 4:
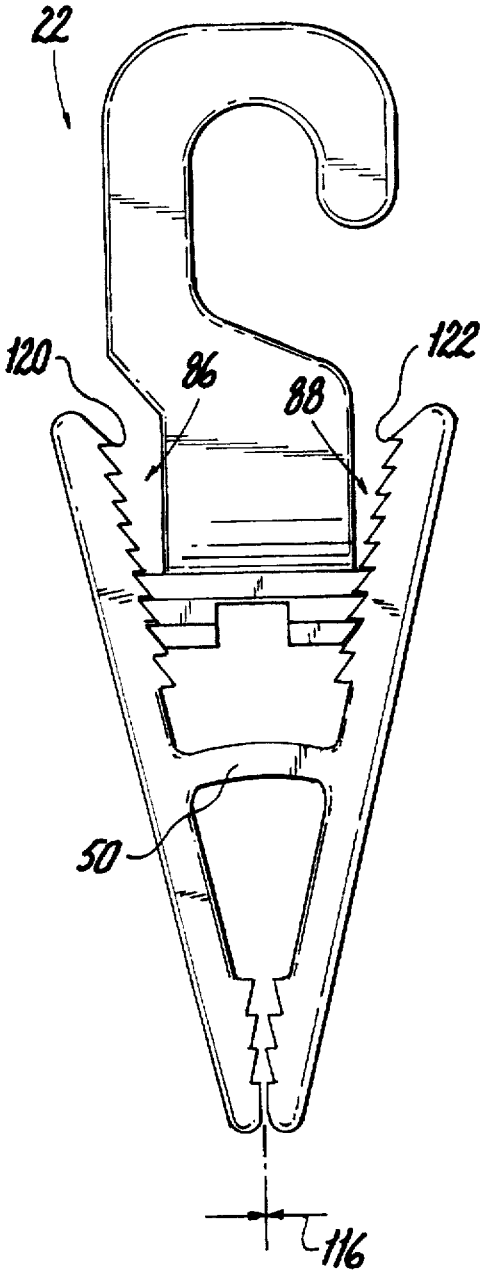
FIG. 4 is a front view of the clip of FIG. 1 shown with the locking insert thrust body engaging the frontmost serrations of the lever portions of the clip to close the jaws of the clip.

In FIG. 4, thrust body 22 is closer to joiner 50 than it is in FIG. 3, resulting in space 116 between the jaws in a closed position that is smaller than space 114. A closed position need not be with the jaws in contact with one another, but is one in which they are closer together than they would be with the serration of the thrust body in engagement with the serration of the two levers at the back of the clip, and in which the serration of the thrust body is engaging the serration of the two levers forward of the back ends 120 and 122 of the serration on sides 86 and 88 of the two levers.

Figure 5:
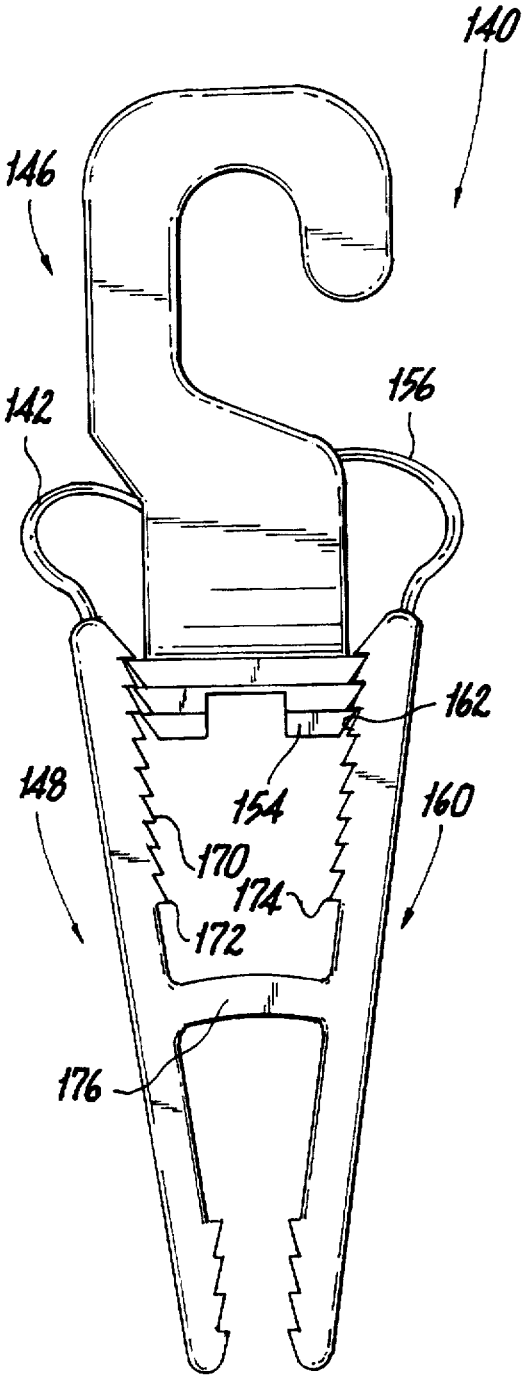
FIG. 5 is a front view of the clip of the invention incorporating a flexible line connecting the lower portion and locking the insert.
Figure 6:
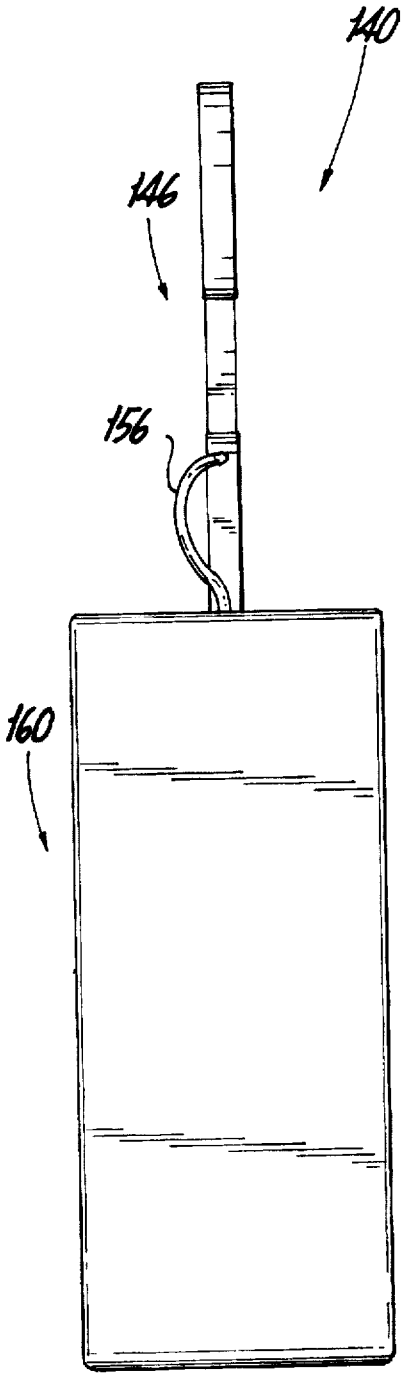
FIG. 6 is a front side view of the clip of FIG. 5.
Figure 7:
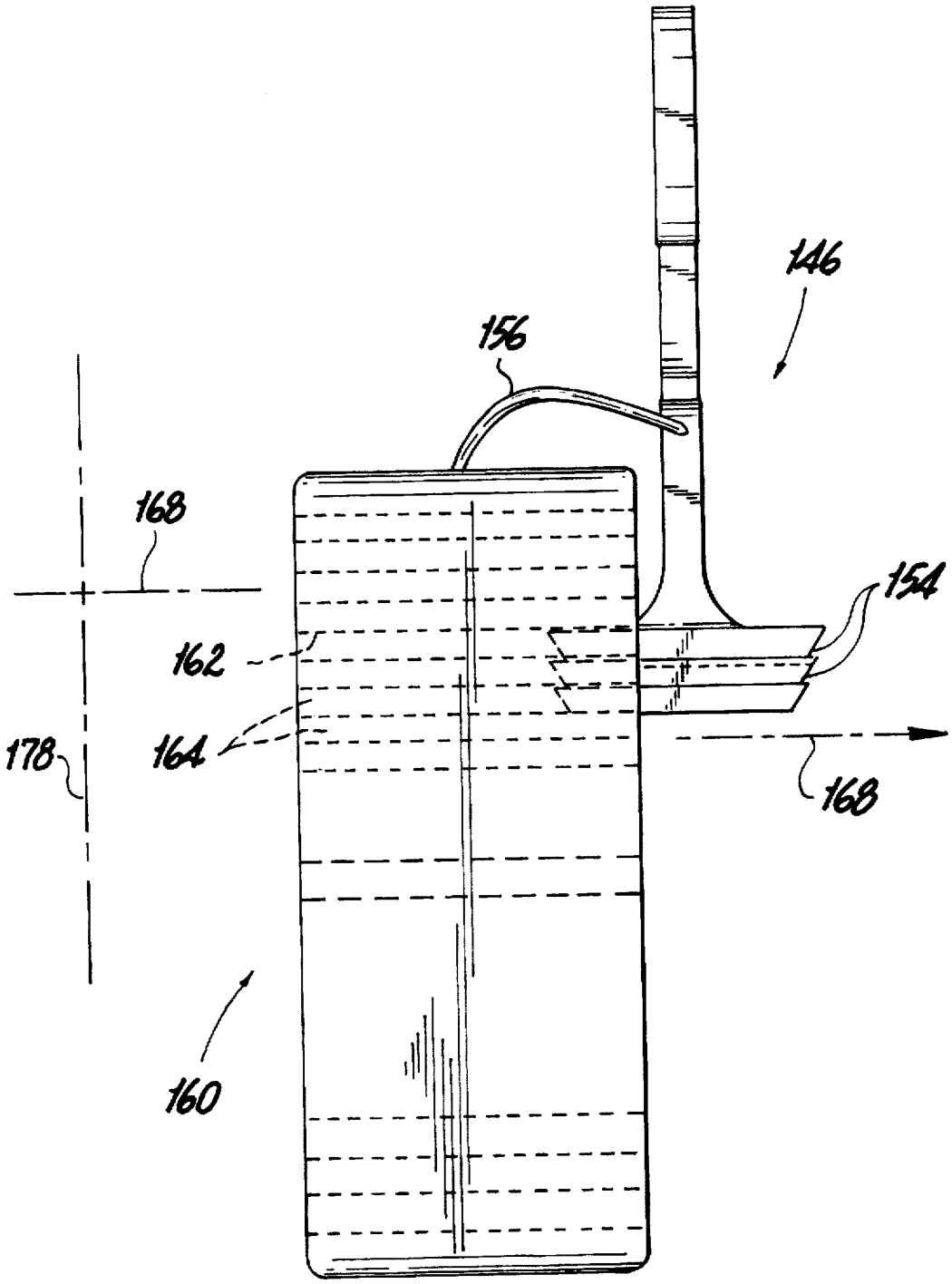
FIG. 7 is a right side view of the clip of FIG. 5 shown with the locking element thrust body of the clip moved laterally.

In FIGS. 5, 6, and 7, Clip 140 has flexible line 142 attached thrust body 146 and body member 148, and flexible line 156 attached to thrust body 146 and body member 160.

In FIG. 6, the thrust body is centered on body member 160.

In FIG. 7, serration 154 of thrust body 146 is partially removed from serration 162. The grooves 164 of serration 162 are transverse 168 to the length 178 of the clip and open to a side of the clip so that the thrust body is removable from between body members 148 and 160 by sliding 168 laterally to the length until the serration of the thrust body exits from serration 162 of body member 160. By that action the serration of the thrust body also exits from serration 170 of body member 148. A finger of the hand holding the clip can be used to slide the thrust body from the clip.

Thrust body 146, flexible lines 142 and 156, body members 148 and 160, and joiner 176 are molded in one piece.

Lines 142 and 156 are each long enough to permit insertion of the thrust body to the front ends 172 and 174 of serration 170 and 162 respectively, but too short to pertain removal of serration 154 of the thrust body from all portions of serration 162 without breaking the lines. The broken line provides tamper indication of the first removal of the thrust body from between body members 148 and 160, and the clip is reusable afterwards.

Figure 8:
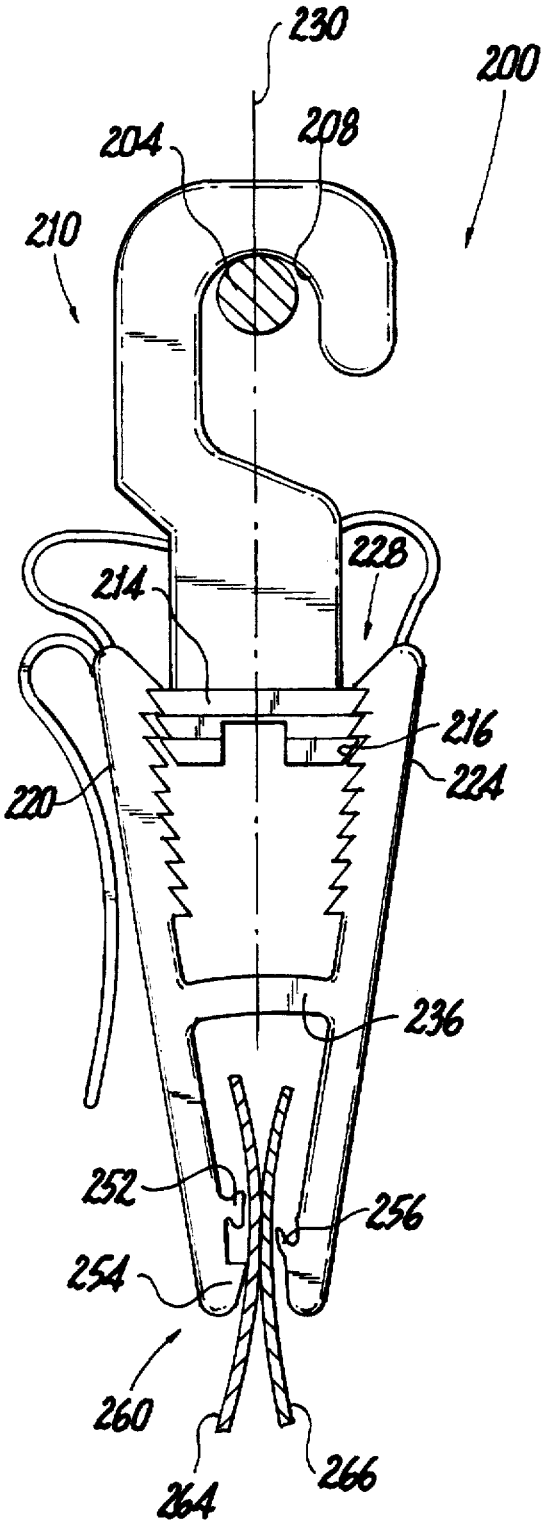
FIG. 8 is a front view of a clip and locking insert thrust body of the invention incorporating modified teeth on the jaws and a bracket to support a label and ??? pieces of material held in the jaws of the clip.
Figure 9:
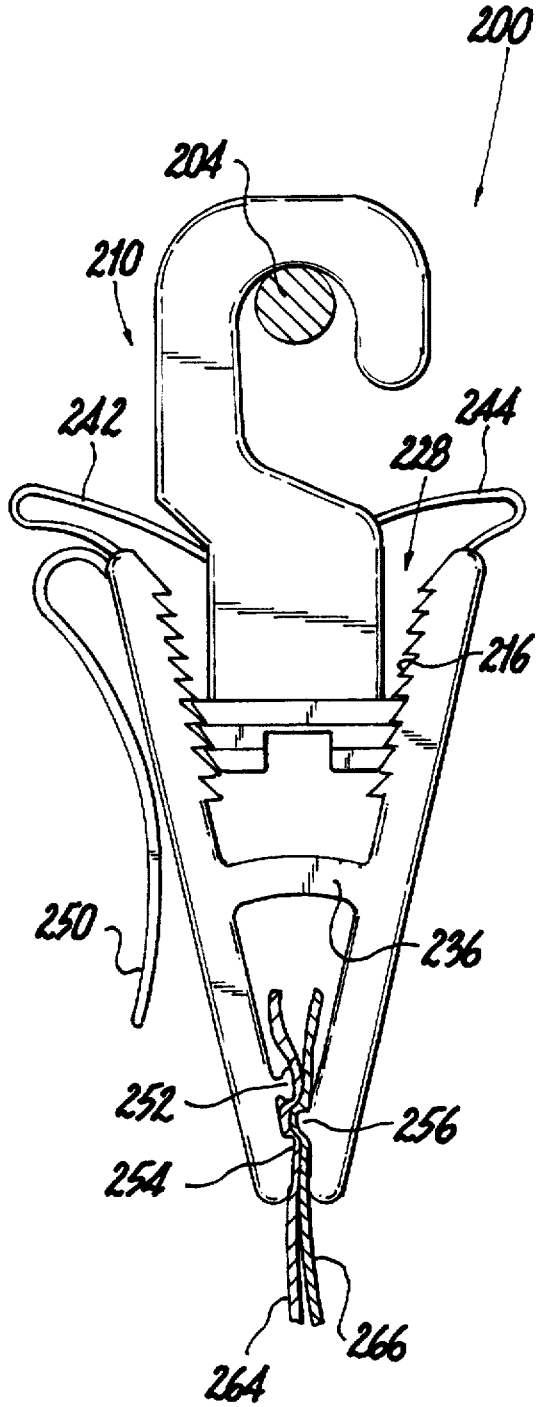
FIG. 9 is a front view of the clip of FIG. 8.
Figure 10:
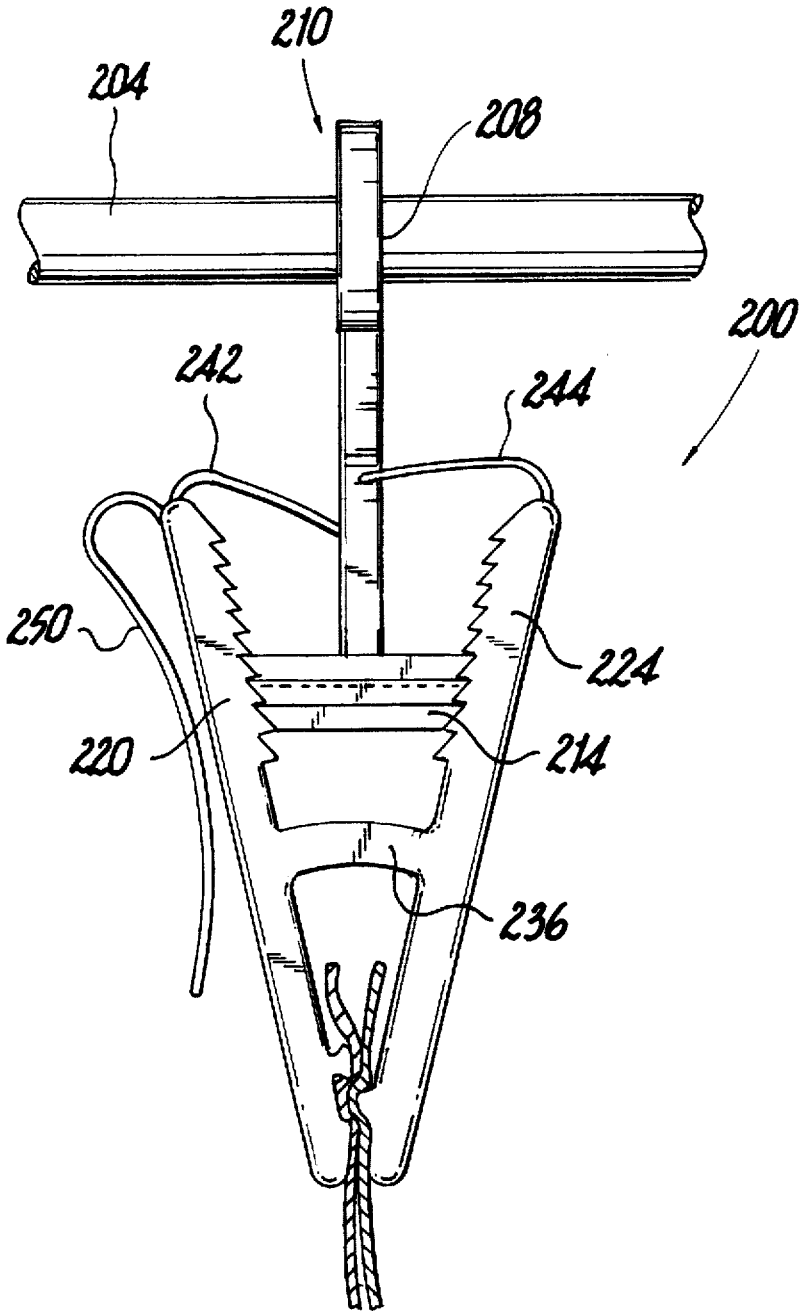
FIG. 10 is a front view of the clip of FIG. 8 with the locking insert thrust body of the clip rotated 90 degrees.
Figure 11:
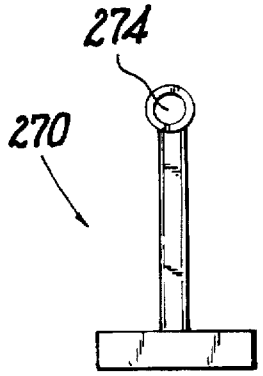
FIG. 11 is a left sideview of a modified locking insert thrust body of a clip of the invention.
Figure 12:
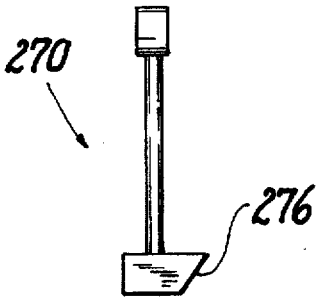
FIG. 12 is a front view of the thrust body of FIG. 11.
Figure 13:
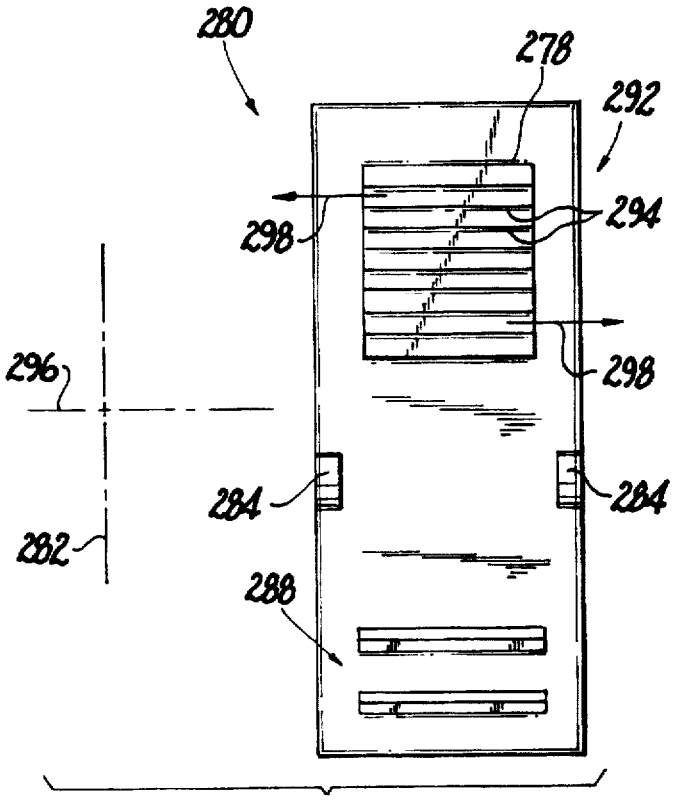
FIG. 13 is a left side view of a modified body member comprising the jaw and lever portions of a clip of the invention.
Figure 14:
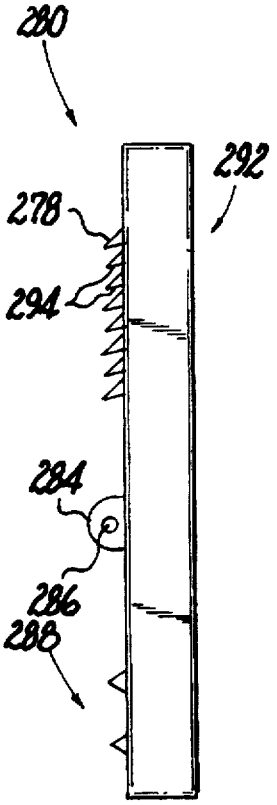
FIG. 14 is a front view of the body member of FIG. 13.

In FIGS. 8, 9, and 10, clip 200 hangs from retail display bar 204 by hook 208 of thrust body 210. Serration 214 on thrust body 210 engages serration 216 on levers 220 and 224 so that the thrust body cannot be pulled out of the back 228 of the clip by sliding the thrust body along the levers anywhere along the axial length 230 of serration 216 in the direction from joiner 236 to back 228 of the clip. Thrust body 210 at either of the positions between the levers of FIGS. 8 and 9, supports the clip from bar 204 without slipping backward in the clip with even the heaviest of loads that the clip jaws can hold.

Since thrust body 210 does not slip backward under rearward pull upon the thrust body relative to the levers, lever spacing and jaw spacing of the thrust body position remain constant and unaffected by the amount of weight held by the jaws when the clip is hung by the thrust body.

In FIG. 10, thrust body 210 is turned 90 degrees from its position in FIGS. 8 and 9 with respect to levers 220 and 224. Flexible lines 242 and 244 are long enough to follow the turn of thrust body 210.

Bracket 250 may hold a placard or may be used to hang the clip from a thin support.

Interlocking teeth 252, 254 and 256 on jaws 260 provide a strong grip for thick and thin flexible items such as the two layers of cloth 264 and 266.

In FIGS. 11, 12, 13, and 14, thrust body 270 includes opening 274 for attaching the thrust body to a support means such as a display hook. Serration 276 fits serration 278 of body member 280 and is slidable longitudinally 282 of the body member. Joiner 284 has opening 286 for a pivot pin so that a complimentary body member (not shown) can rotate on joiner 284 so that jaw 288 is moved to the jaw of the complimentary body by lever 292 being moved away from the lever of the complimentary body by sliding of the thrust body over serration 278. Grooves 294 of serration 278 are transverse 296 to the length of body member 280 and open to a side 298 of clip so that the thrust body is removable from between the complimentary body members by sliding the thrust body laterally to the length until the serration of the thrust body exits from the serration of the body member.

Although the present invention has been described with respect to details of certain embodiments thereof, it is not intended than such details be limitations upon the scope of the invention. It will be obvious to those skilled in the art that various modifications and substitutions may be made without departing from the spirit and scope of the invention as set forth in the following claims.

I claim:

1. A clip having a front, a back, a length on a line through said front and back, and comprising:

a first body member comprising a first jaw toward the front and a first lever toward the back, a second body member comprising a second jaw and a second lever, joining means connecting said first body member to said second body member between the jaws and the levers so that the first and second jaws are moved toward one and another by the first and second levers when the first and second levers are moved away from one another, said first lever comprising a first side facing said second lever, said second lever comprising a second side facing said first lever, a third body member, dimensioned to fit between the first and second levers in close contact with the first and second levers, between said joining means and the back of the clip when the jaws of the clip are in a closed position, interengageable serration means on said first and second sides and on said third body member, said third body member being slidable on said first and second sides in a direction from the back of said clip to said joining means simultaneously with said serration means on said sides and on said third body member interengaging for adjusting said clip from open jaws to maximum jaw closure.

2. The clip of claim 1, wherein said interengaging serration means also comprise:

means for preventing sliding along a portion of the length of said first and second sides by said third body member in a direction from said joining means toward the back of said clip.

3. The clip of claim 1 wherein:

said interengaging serration means comprise grooves which are transverse to the length of said clip and open to a side of said clip so that said third body member is removable from between the first and second body members by sliding laterally to said length.

4. The clip of claim 3, wherein:

a flexible line is attached to said third body member and said first body member.

5. The clip of claim 4, wherein:

said flexible line is long enough to permit sliding of said third body member between said first and second levers sufficiently to move said first and second jaws to a closed position.

6. The clip of claim 5, wherein:

said flexible line is too short to permit removal of said third body member from all portions of said serration.

7. The clip of claim 6, wherein:

said first body member, second body member, third body member, joining means, and flexible line comprise a one piece molding.

8. The clip of claim 1, further comprising:

attachment means on said third body member for attaching said third body member to a support for supporting said clip by said third body member.

9. The clip of claim 1, further comprising:

said third body member having a plurality of sides, at least two of adjacent sides of said plurality of sides having said serration means.

10. The clip of claim 1, further comprising:

a flexible line attached to said third body member and said first body member, said flexible line being long enough to permit sliding of said third body member between the first and second levers sufficiently to move the first and second jaws to a closed position.

11. The clip of claim 1, further comprising:

said first body member, second body member, third body member and joining means being a one piece molding.

12. A clip having a front, a back, a length on a line through said front and back, and comprising:

a first body member comprising a first jaw toward the front and a first lever toward the back, a second body member comprising a second jaw and a second lever, joining means connecting said first body member to said second body member between the jaws and the levers so that the first and second jaws are moved toward one another by the first and second levers when the first and second levers are moved away from one another.

said first lever comprising a first side facing said second lever, a third body member, dimensioned to fit between the first and second levers in close contact with the first and second levers, between said joining means and the back of the clip when the jaws of the clip are in a closed position, a first serration on said third body member, a second serration on said first side, said third body member being slidable in the direction from said back to said joining means simultaneously with said first serration in contact with said second serration so that said clip can be adjusted from open jaws to maximum jaw closure by sliding said third body member in a single unidirectional movement from said back to said joining means.

13. The clip of claim 12, further comprising:

means on said third body member for preventing sliding along a portion of the length said first side by said third body member in a direction from said joining means toward the back of said clip.

14. The clip of claim 13, further comprising:

said means on said third body member for preventing sliding along said first side comprising serration between said third body member and said first body member, the grooves of said serration being transverse to the length of said clip and open to a side of said clip so that said third body member is removable from between the first and second body members by sliding laterally to said length.

15. The clip of claim 12, further comprising:

a flexible line attached to said third body member and said first body member, said flexible line being too short to permit removal of said third body member from all portions of said serration.

16. The clip of claim 12, further comprising:

said third body member having a plurality of sides, two of adjacent sides of said plurality of sides having serration.

* * * * *